United States Patent [19]

Tsuji et al.

[11] 4,087,050

[45] May 2, 1978

[54] SWIRL TYPE PRESSURE FUEL ATOMIZER

[75] Inventors: Shoichi Tsuji, Hoya; Minoru Asai, Kamagaya; Yuichi Fujii, Funabashi, all of Japan

[73] Assignee: Ishikawajima-Harima Jukogyo Kabushiki Kaisha, Ote, Japan

[21] Appl. No.: 743,013

[22] Filed: Nov. 18, 1976

Related U.S. Application Data

[60] Continuation of Ser. No. 614,447, Sep. 18, 1975, abandoned, which is a division of Ser. No. 405,559, Oct. 24, 1973, abandoned.

[51] Int. Cl.[2] ..... B05B 1/34

[52] U.S. Cl. ..... 239/490; 239/492; 239/496; 239/568

[58] Field of Search ..... 239/404, 406, 425, 467, 239/491, 493, 498, 502, 518, 489, 568, 492, 494, 490, 466, 403, 496

[56] References Cited

U.S. PATENT DOCUMENTS

| | | | |
|---|---|---|---|
| 1,332,667 | 3/1920 | Irish | 239/494 X |
| 1,431,526 | 10/1922 | Jacobsen | 239/490 |
| 1,667,943 | 5/1928 | Munz | 239/467 X |
| 2,242,680 | 5/1941 | Schacht | 239/489 |
| 3,275,248 | 9/1966 | O'Brien et al. | 239/489 X |
| 3,347,471 | 10/1967 | Halls | 239/466 |

*Primary Examiner*—John J. Love

*Attorney, Agent, or Firm*—Marvin A. Naigur; John E. Wilson

[57] ABSTRACT

An improvement of a swirl type fuel atomizer is disclosed in which a plurality of projections, grooves or recesses are equiangularly formed around an opening of a single-nozzle hole so that the liquid fuel injected may be divided into a plurality of fuel spray patterns. The complete combustion with a relatively low temperature may be ensured so that the emission of nitrogen oxides may be substantially eliminated or reduced.

9 Claims, 19 Drawing Figures

SWIRL TYPE PRESSURE FUEL ATOMIZER

CROSS-REFERENCE TO RELATED APPLICATION

This is a continuation of application Ser. No. 614,447 filed Sept. 18, 1975, now abandoned which, in turn, is a division of application Ser. No. 405,559 filed Oct. 24, 1973, now abandoned.

The present invention relates to generally a fuel injector and more particularly, an improvement of a swirl type fuel atomizer.

The emission of nitrogen oxides from the furnaces, boilers, and so on presents a serious air pollution problem. When the conventional swirl type fuel atomizer of the type in which the swirling liquid fuel is continuously injected through a single-nozzle hole so as to form a relatively large and single flame is produced and the flame temperature is high so that the combustion products remain within the flame for a long time, thus resulting in the increase in quantity of nitrogen oxides in the final combustion products.

One of the objects of the present invention is therefore to provide an improved swirl type fuel atomizer which may ensure the complete combustion with a relatively low temperature, thus substantially eliminating the emission of pollutants such as nitrogen oxides.

According to the aspect of the present invention, a plurality of projections, grooves or recesses are equiangularly formed around or adjacent to an opening of a single-nozzle port of a nozzle tip of a swirl type fuel atomizer so that liquid fuel injected may be divided into a plurality of fuel spray patterns. Therefore a plurality of small flames are produced so that the total surface area of the flames may be considerably increased. As a result the heat radiation is facilitated so that the flame temperature is decreased and the production of nitrogen oxides is prevented.

The above and other objects, features and advantages of the present invention will become more apparent from the following description of preferred embodiments thereof taken in conjunction with the accompanying drawing.

Figure 1A:
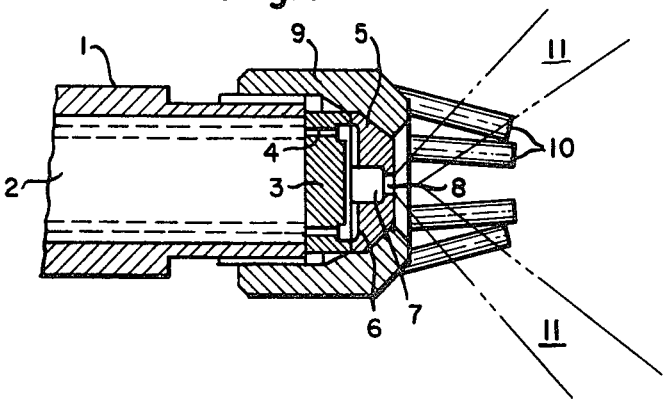
FIG. 1A is a longitudinal sectional view of a first embodiment of the present invention.
Figure 1B:
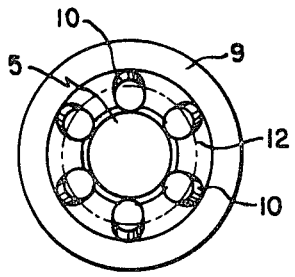
FIG. 1B is a front view thereof.

The first embodiment shown in FIGS. 1A and 1B comprises a nozzle holder 1 having a liquid fuel passage 2, a fuel guide ring 3 having liquid fuel passages 4 in communication with the fuel passage 2, a nozzle tip 5, and a nozzle assembly cap or nut 9.

The nozzle tip 5 has tangential grooves 6 in communication with the fuel passages 4 in the fuel guide ring 3 and with a swirl chamber 7 and a nozzle hole 8. The liquid fuel under pressure flows through the fuel passage 2 in the nozzle holder 1, the fuel passages 4 in the guide ring 3, the tangential grooves 6 and the swirl chamber 7 in the nozzle tip 5, and is injected through the nozzle hole 8 to form a conical fuel spray pattern as in the case of the conventional swirl type fuel atomizers.

According to the present invention, six rod members 10 are axially extended equiangularly along a circle 12 coaxial of the nozzle hole 8 from the front end surface of the nozzle cap 9 so that the cone shaped spray formed by the fuel injected through the nozzle hole 8 may be divided into six fuel spray groups 11. The rod members 10 may be extended from the front end surface of the nozzle tip 5.

The fuel is guided from the fuel passage 2 of the nozzle holder 1 to the tangential grooves 6 via the fuel passages 4 of the guide ring 3, it takes the form of swirling flow in the swirl chamber 7 and is injected from the nozzle hole 8 as the continuous cone shaped spray. But it collides to rod members 10 installed at nozzle cap 9, and forms divided fuel spray groups 11.

Figure 2A:
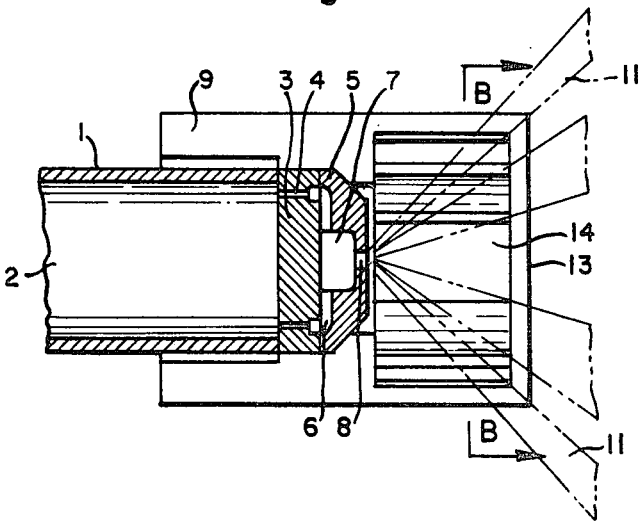
FIG. 2A is a longitudinal sectional view of a second embodiment of the present invention.
Figure 2B:
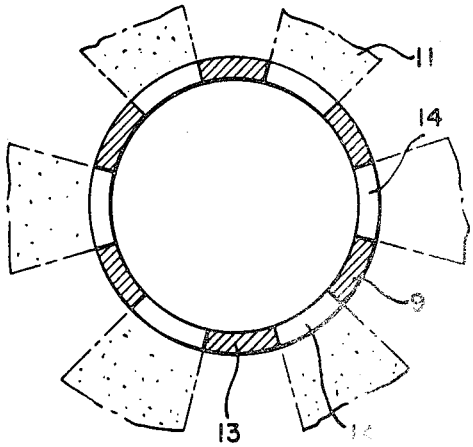
FIG. 2B is a front view thereof.

The second embodiment shown in FIGS. 2A and 2B is substantially similar in construction to the first embodiment except that the nozzle cap 9 is in the form of a cage and that the rod members 10 are eliminated. That is, through the wall of the front end portion 13 of the nozzle cap 9 are formed a plurality of spray passages 14 which pass through a part of a cone whose apex coincides with the nozzle hole 8 and whose apex or vertical angle is determined depending upon the shape of the nozzle hole 8, the pressure, viscosity, and specific weight of liquid fuel to be sprayed and so on. In this case, the fuel is guided from the fuel passage 2 of the nozzle holder 1 to the tangential grooves 6 via the fuel passages 4 of the guide ring 3, it takes the form of swirling flow in the swirl chamber 7 and is injected from the nozzle hole 8 with cone shaped spray continuously. But, as the front end portion of the nozzle cap 9 is a project portion 13 in the form of a cage, the cone shaped spray injected through the nozzle hole 8 is divided by the six spray passages 14 into six fuel spray groups 11.

Figure 2C:
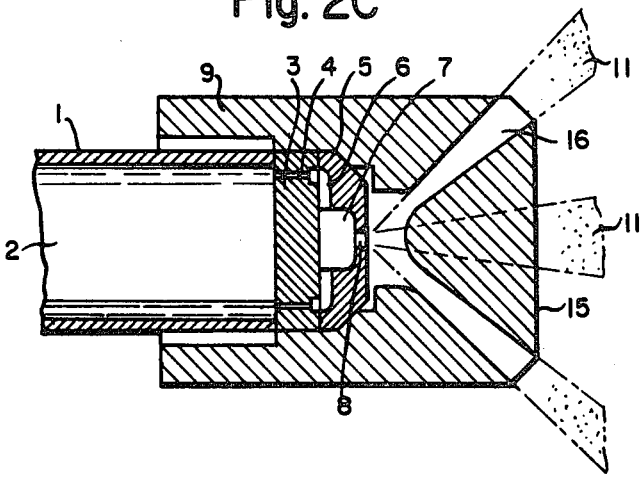
FIG. 2C is a longitudinal sectional view of a third embodiment of the present invention.
Figure 2D:
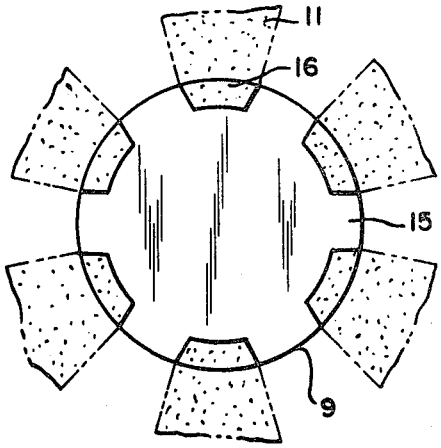
FIG. 2D is a top view thereof.

The third embodiment shown in FIGS. 2C and 2D is substantially similar in construction to the second embodiment shown in FIGS. 2A and 2B except that the front end portion 15 of the nozzle assembly cap 9 is solid and six spray passages 16 are formed through the front end portion 15. The axes of the spray passages 16 lie in the surface of a cone whose axis coincides with the axis of the nozzle cap 9, and the cross section of each of the spray passages 16 is frustoconical as best shown in FIG. 2C. Therefore the six conical-shaped spray groups 11 are formed.

In the second and third embodiments, the nozzle tip 5 and the nozzle assembly cap 9 have been described as being separate parts, but it will be understood that they may be fabricated as a unitary construction.

The fourth embodiment shown in FIG. 3 is substantially similar in construction to the first embodiment shown in FIG. 1 except that the rod members are eliminated and that the opening of the single-nozzle hole 8 is not round. That is, around the opening of the nozzle hole 8 are formed tangential or radial grooves 17 of projections 17' as shown in FIGS. 3D, 3F or 3H, respectively.

Figure 3A:
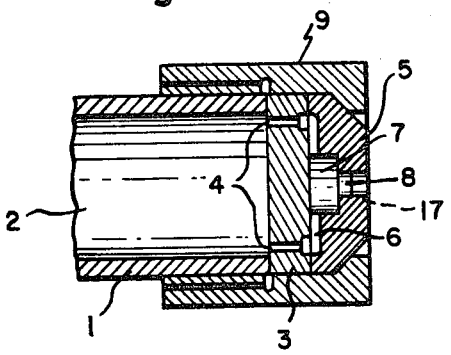
FIG. 3A is a sectional view of a fourth embodiment of the present invention.
Figure 3B:
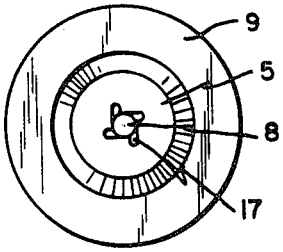
FIG. 3B is a front view thereof.

As shown in FIGS. 3A and 3B, the fuel is guided from the fuel passage 2 of the nozzle holder 1 to the tangential grooves 6 via the fuel passages 4 of the guide ring 3, it takes the form of swirling flow in the swirl chamber 7 and injected from the nozzle hole 8.

Figure 3C:
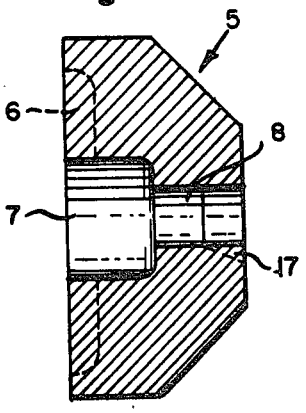
FIG. 3C is a sectional view, on enlarged scale of a nozzle tip thereof.
Figure 3D:
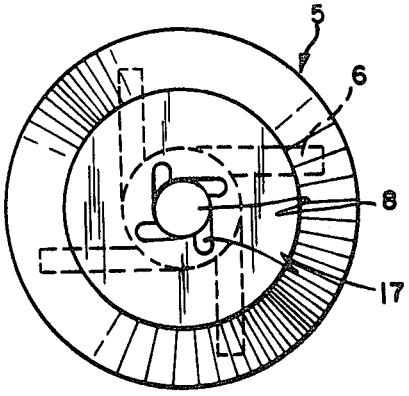
FIG. 3D is a front view thereof.

Referring particularly to FIGS. 3C and 3D, four tangential grooves 17 are formed equiangularly around the opening of the nozzle hole 8 so that liquid fuel injected under high pressure through the nozzle 8 is divided by the tangential grooves 17, thereby forming separate spray groups.

Figure 3E:
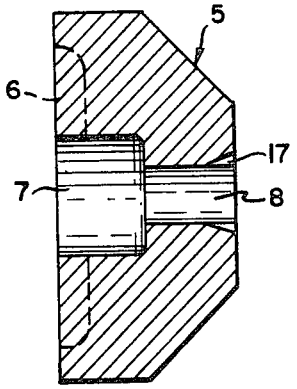
FIG. 3E is a sectional view of a variation of a nozzle tip.
Figure 3F:
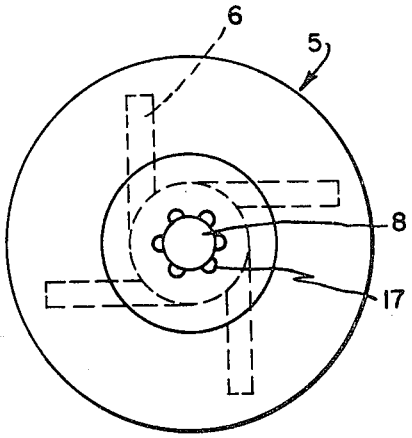
FIG. 3F is a front view thereof.

The radial grooves or recesses 17 are equiangularly formed around the opening of the nozzle hole 8 in the variation shown in FIGS. 3E and 3F. The radial grooves or recesses 17 are semi-conical in cross section as best shown in FIG. 3E. The liquid fuel injected through the nozzle hole 8 is also divided into a plurality of separate spray groups.

Figure 3G:
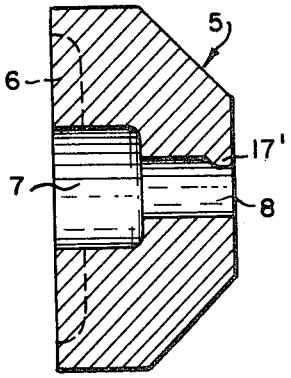
FIG. 3G is a sectional view of another variation of a nozzle tip.
Figure 3H:
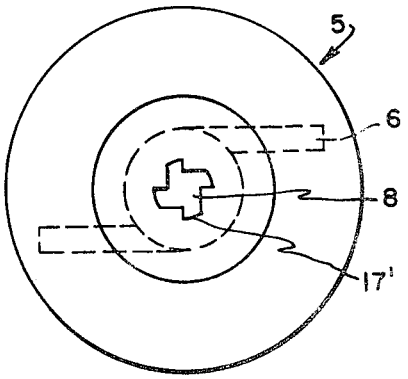
FIG. 3H is a front view thereof.
Figure 4A:
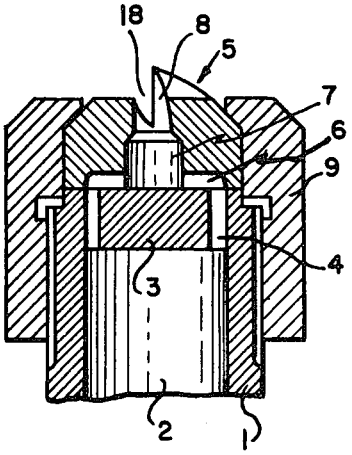
FIG. 4A is a sectional view of a fifth embodiment of the present invention.
Figure 4C:
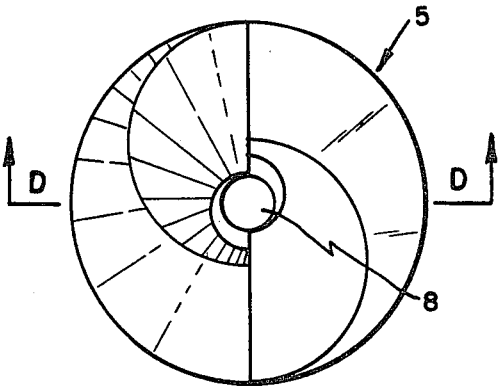
FIG. 4C is a front view thereof.
Figure 4D:
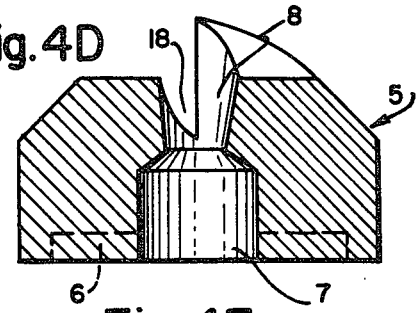
FIG. 4D is a sectional view taken along the line D—D of FIG. 4C.
Figure 4B:
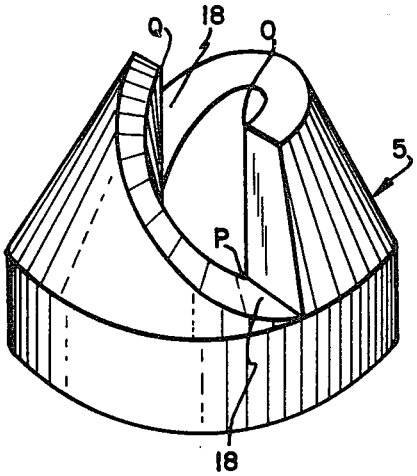
FIG. 4B is a fragmentary perspective view, on enlarged scale, of a nozzle tip thereof.
Figure 4E:
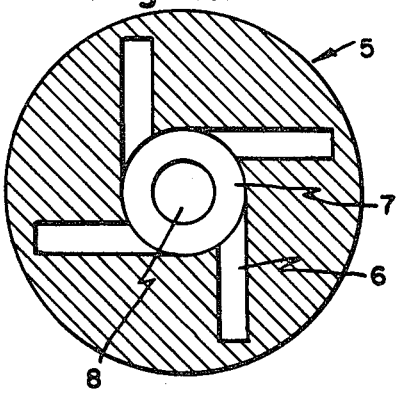
FIG. 4E is a rear view of the nozzle tip.

In the variation shown in FIGS. 3G and 3H, the projections 17' are equiangularly extended radially inwardly so that the liquid fuel injected through the nozzle hole 8 is also divided into a plurality of separate spray groups.

In summary in the third embodiment of the present invention, a plurality of equiangularly spaced apart symmetrical grooves or projections in any suitable form are formed around the opening of a round nozzle hole so that the liquid fuel injected through the nozzle hole may be divided into a plurality of separate spray groups.

The fifth embodiment shown in FIG. 4.

FIG. 4 shows a case wherein a plurality of sawtooth-shaped notches have been made at the tip of the nozzle hole. As shown by FIG. 4A, the jet valve shown by FIG. 4 is composed of the nozzle holder 1, the guide ring 3, and the sawtooth-shaped notches 18 combined with one another by means of the nozzle cap 9; and the fuel is guided from the fuel passage 2 of the nozzle holder 1 to the tangential grooves 6 via the fuel passages 4 of the guide ring 3, so that it takes the form of swirling flow in the swirl chamber 7 and spurts out from the nozzle hole 8. The following explanation is concerned with the breaking of spray and the formation of spray groups on a predetermined substantially flat plane in the axial direction. The sawtooth-shaped notches 18 at the tip of the nozzle hole has the shape as shown by the oblique view in FIG. 4B, and at the nozzle tip 5 having the sawtooth-shaped notches 18, the fuel, which forms a swirling stream by flowing from the tangential grooves 6 into the swirl chamber 7, is spurted out in the tangential direction from the notched side which is parallel with the axis formed at the sawtooth-shaped notches 18 made at the nozzle hole 8; therefore it is possible to form divided spray groups on a predetermined substantially flat plane. The swirling fuel injected through the nozzle hole 8 is therefore sprayed along a plane containing the axis of the nozzle hole 8 and the spray line (the line connecting the points O and P in FIG. 4B) without colliding against a relief line (the line connecting the points P and Q in FIG. 4B). Thus the fuel is sprayed along separate planes containing the axis of the nozzle hole 8.

As described hereinbefore, the swirling type pressure fuel atomizers are capable of spraying the liquid fuel injected under pressure in the form of divided spray patterns so that a plurality of small flames are produced. As a result the overall surface area of the small flames is considerably increased so that the complete combustion with a relatively low temperature may be ensured. Therefore the production of nitrogen oxides may be substantially eliminated or reduced considerably. The emission of nitrogen oxides may be further eliminated or reduced because the high temperature gas or combustion products pass the flame within a very short time. Thus, opposed to the conventional fuel atomizers which produce a large and single flame with a high temperature with the result of the emission of a large quantity of nitrogenoxides, the fuel atomizers of the present invention may eliminate the air pollution problem.

The embodiment of the invention in which an exclusive property or privilege is claimed are defined as follows:

1. A burner assembly comprising a housing having a main flow passage therein adapted to receive fuel at one end thereof; a nozzle tip secured to said housing and having an inner wall portion defining a nozzle hole aligned along a nozzle axis; one end of said nozzle hole functioning as an outlet opening for said fuel; a chamber of larger diameter than said nozzle hole and having one end registering with the other end of said nozzle hole; a plurality of grooves extending tangentially to said chamber adjacent the other end thereof; means for receiving said fuel from said main flow passage and dividing said fuel into a plurality of relatively small flow streams extending parallel to the axis of said main flow passage and said chamber and respectively registering with said grooves so that said grooves impart a swirl to said fuel as it passes through said chamber; said inner wall of said nozzle tip defining said nozzle hole being provided with a plurality of spaced discharge grooves formed therein to divide the fuel discharging from said outlet opening into a plurality of separate spray patterns; said discharge grooves being bevelled with respect to said axis and diverging toward said outlet opening.

2. The burner assembly of claim 1, wherein said outlet opening is circular in cross section and wherein said discharge grooves are circumferentially spaced around said wall and extend symmetrically with respect to the center of said outlet opening.

3. The burner assembly of claim 1, wherein said discharge grooves extend tangentially with respect to said outlet opening.

4. The burner assembly of claim 1, wherein said means for imparting a swirl to said fuel comprises a plurality of grooves formed in the inner wall of said nozzle tip defining said one chamber, said grooves extending tangentially to said one chamber.

5. A burner assembly comprising a housing having a main flow passage therein adapted to receive fuel at one end thereof; a nozzle tip secured to said housing having an inner wall portion defining a nozzle hole aligned along a nozzle axis; one end of said nozzle hole functioning as an outlet opening for said fuel; a chamber of larger diameter than said nozzle hole having one end registering with the other end of said nozzle hole; a plurality of grooves extending tangentially to said chamber adjacent the other end thereof; means for receiving said fuel from said main flow passage and dividing said fuel into a plurality of relatively small flow streams extending parallel to the axis of said main flow passage and said chamber and respectively registering with said grooves so that said grooves impart a swirl to said fuel as it passes through said chamber; said inner wall defining said nozzle hole being provided with a plurality of spaced projections which extend radially inward from said wall to divide the fuel discharging from said outlet opening into a plurality of separate spray patterns; each of said projections having a portion bevelled with respect to said axis and another portion substantially parallel to said axis.

6. The burner assembly of claim 5, wherein said outlet opening is circular in cross section and wherein said projections are circumferentially spaced around said wall and extend symmetrically with respect to the center of said outlet opening.

7. The burner assembly of claim 5, wherein said nozzle hole and said chamber are cylindrical in shape and extend coaxially with said passage.

8. The burner assembly of claim 7, wherein the diameter of said nozzle hole is less than that of said chamber.

9. The burner assembly of claim 5, wherein said means for imparting a swirl to said fuel comprises a plurality of grooves formed in the inner wall of said nozzle tip defining said chamber, said grooves extending tangentially to said chamber.

* * * * *